US010176769B2

(12) United States Patent
Liu et al.

(10) Patent No.: US 10,176,769 B2
(45) Date of Patent: Jan. 8, 2019

(54) LIQUID CRYSTAL DISPLAY METHOD AND DEVICE, AND STORAGE MEDIUM

(71) Applicant: Xiaomi Inc., Beijing (CN)

(72) Inventors: Anyu Liu, Beijing (CN); Lei Yu, Beijing (CN); Guosheng Li, Beijing (CN)

(73) Assignee: Xiaomi Inc., Beijing (CN)

( * ) Notice: Subject to any disclaimer, the term of this patent is extended or adjusted under 35 U.S.C. 154(b) by 0 days.

(21) Appl. No.: 15/074,831

(22) Filed: Mar. 18, 2016

(65) Prior Publication Data

US 2017/0140718 A1 May 18, 2017

(30) Foreign Application Priority Data

Nov. 12, 2015 (CN) ..... 2015 1 0772732

(51) Int. Cl.
*G09G 3/36* (2006.01)

(52) U.S. Cl.
CPC ..... *G09G 3/3607* (2013.01); *G09G 3/3618* (2013.01); *G09G 3/3648* (2013.01); (Continued)

(58) Field of Classification Search
CPC ..... G09G 3/3607; G09G 3/3618; G09G 2310/027; G09G 5/02; G09G 5/06; (Continued)

(56) References Cited

U.S. PATENT DOCUMENTS

2007/0146294 A1 6/2007 Nurmi et al.
2008/0036753 A1 2/2008 Washio et al.
(Continued)

FOREIGN PATENT DOCUMENTS

CN 101593498 A 12/2009
CN 102968978 A 3/2013
(Continued)

OTHER PUBLICATIONS

Extended European Search Report dated Jul. 8, 2016 for European Application No. 16158522.9, 11 pages.
(Continued)

*Primary Examiner* — Xilin Guo
(74) *Attorney, Agent, or Firm* — Brinks, Gilson & Lione

(57) ABSTRACT

The present disclosure discloses a liquid crystal display method and device, and a storage medium, and it relates to the field of liquid crystal display. The method include acquiring a grayscale value of each row of a content displayed on a liquid crystal panel, determining whether the pixel grayscale values of a plurality the pixels in the i-th row of the displayed content are lower than a predetermined value, setting a refresh rate of the i-th row of the displayed content to a first refresh rate when the grayscale values of the plurality of pixels in the i-th row are below the predetermined value, determining whether at least one pixel grayscale value of the pixels in the j-th row is not lower than the predetermined value, and setting a refresh rate of the j-th row in the displayed content to a second refresh rate if at least one pixel grayscale value of the pixels in the j-th row is not lower than a predetermined value. The first refresh rate is lower than the second.

19 Claims, 7 Drawing Sheets

(52) U.S. Cl.
CPC ..... *G09G 2310/027* (2013.01); *G09G 2320/0247* (2013.01); *G09G 2320/103* (2013.01); *G09G 2330/021* (2013.01); *G09G 2340/0435* (2013.01); *G09G 2360/16* (2013.01)

(58) Field of Classification Search
CPC ..... G09G 2320/0666; G09G 2340/06; G09G 3/20; G09G 3/36; G09G 3/3648; G09G 2340/0435; G09G 2320/0252; G09G 2360/16; G09G 2310/08; G09G 2320/0285; G09G 3/3611; G09G 2320/0204; G09G 2360/18; G09G 3/2018; G09G 3/006; G09G 2320/062; G09G 2320/08; G09G 3/3413; G09G 3/3426; G09G 2310/0248; G09G 3/2074; G06T 11/001; G06T 7/11; G06T 7/187; G06T 2207/20021; G06T 5/00; G06T 7/001; G06T 7/337; G06T 7/44; G06T 7/90; G06T 2207/20216; G02F 2001/134345; H01L 27/3244; H01L 27/3276; H04N 13/189; H04N 5/2355
See application file for complete search history.

(56) References Cited

U.S. PATENT DOCUMENTS

| | | | | |
|---|---|---|---|---|
| 2009/0213042 | A1* | 8/2009 | Hagino | G09G 3/2011 345/55 |
| 2009/0295786 | A1 | 12/2009 | Ito et al. | |
| 2011/0199404 | A1 | 8/2011 | Umezaki et al. | |
| 2014/0152533 | A1 | 6/2014 | Imada | |
| 2014/0210801 | A1 | 7/2014 | Li | |
| 2014/0313236 | A1 | 10/2014 | Jang et al. | |
| 2015/0130823 | A1 | 5/2015 | Kim et al. | |
| 2015/0287352 | A1* | 10/2015 | Watanabe | G09G 3/20 345/89 |
| 2016/0086557 | A1 | 3/2016 | Watanabe et al. | |
| 2016/0093239 | A1* | 3/2016 | Wang | G06F 1/32 345/55 |
| 2017/0092178 | A1* | 3/2017 | Lee | H01L 27/1225 |

FOREIGN PATENT DOCUMENTS

| | | | |
|---|---|---|---|
| CN | 104813392 | A | 7/2015 |
| EP | 2 804 171 | A2 | 11/2014 |
| EP | 2 905 770 | A2 | 8/2015 |
| EP | 2 924 682 | A1 | 9/2015 |
| JP | 2003-248468 | A | 9/2003 |
| JP | 2011-186449 | A | 9/2011 |
| JP | 2014-211537 | A | 11/2014 |
| RU | 2 491 655 | C2 | 8/2013 |
| WO | WO 2010/067456 | A1 | 6/2010 |
| WO | WO 2010/071221 | A1 | 6/2010 |
| WO | WO 2013/128669 | A1 | 9/2013 |
| WO | WO 2014/080731 | A1 | 5/2014 |
| WO | WO 2014-171323 | A1 | 10/2014 |

OTHER PUBLICATIONS

International Search Report dated Aug. 18, 2016 for International Application No. PCT/CN2015/099036, 12 pages.
Office Action dated Sep. 7, 2017 for Russian Application No. 2016126473/08, 6 pages.
English Translation of International Preliminary Report on Patentability dated May 15, 2018 for International Application No. PCT/CN2015/099036, 10 pages.
Office Action dated Feb. 6, 2018 for Japanese Application No. 2016-519827, 3 pages.

* cited by examiner

LIQUID CRYSTAL DISPLAY METHOD AND DEVICE, AND STORAGE MEDIUM

CROSS-REFERENCE TO RELATED APPLICATIONS

This application is based on and claims priority of the Chinese Patent Application No. 201510772732.7, filed on Nov. 12, 2015, which is incorporated herein by reference in its entirety.

TECHNICAL FIELD

The present disclosure is related to a liquid crystal display, and more particularly, to a liquid crystal display method and device, and a storage medium.

BACKGROUND

Since most terminals are powered by rechargeable batteries, it is very important to control their power consumptions.

At present, there are three major power consumers in a terminal: the liquid crystal panel, the display chip and the backlight. In the related arts, power consumption of terminals is reduced by decreasing power drained by their backlight.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

To solve the problems of reducing power consumption of terminals, the present disclosure provides a liquid crystal display method and device, and a storage medium, the details of which are described in the following.

According to a first aspect of the present disclosure, there is provided a liquid crystal display method, comprising acquiring a pixel grayscale value of each row of a content displayed on a liquid crystal panel, determining whether the pixel grayscale values of a plurality of the pixels in an i-th row of the displayed content are lower than a predetermined value, setting a refresh rate of the i-th row of the displayed content to a first refresh rate when the pixel grayscale values of the plurality of pixels in the i-th row are lower than the predetermined value; and determining whether at least one pixel grayscale value of the pixels in a j-th row is not lower than the predetermined value, and setting a refresh rate of the j-th row in the displayed content to a second refresh rate when at least one grayscale value of the pixels in the j-th row is not lower than the predetermined value. The first refresh rate is lower than the second refresh rate.

Setting a refresh rate of an i-th row in the displayed content to a first refresh rate when the grayscale values of the plurality of pixels in the i-th row are lower than a predetermined value may include sending to a display chip a refresh rate setting instruction corresponding to the i-th row, and causing the display chip to set the refresh rate of the i-th row to the first refresh rate in response to the refresh rate setting instruction.

Setting a refresh rate of an i-th row in the displayed content to a first refresh rate when the grayscale values of the plurality of pixels in the i-th row are lower than the predetermined value may include causing a display chip to set a refresh rate of an i-th row in the displayed content to a first refresh rate if the grayscale values of the plurality of pixels in the i-th row are lower than the predetermined value.

The method may further include re-acquiring a pixel grayscale value of each row in the displayed content on the liquid crystal panel when the content has changed.

The method may further include acquiring a current display mode. A display mode may include a static display mode and a dynamic display mode. The static display mode is a display mode in which the displayed content remains unchanged for a predetermined period of time, and the dynamic display mode is a display mode in which the displayed content is changed within the predetermined period of time. The method may further include acquiring a pixel grayscale value of each row in the displayed content on the liquid crystal panel when the current display mode is in the static display mode.

According to a second aspect of the present disclosure, there is provided a liquid crystal display device, including an acquiring module configured to acquire pixel grayscale values of selected pixels of a row in a displayed content on a liquid crystal panel, a first setting module configured to set a refresh rate of an i-th row in the displayed content to a first refresh rate when the grayscale values of the selected pixels in the i-th row are lower than a predetermined value, and a second setting module configured to set a refresh rate of a j-th row in the displayed content to a second refresh rate when there is one grayscale value of the selected pixels in the j-th row are not lower than the predetermined value. The first refresh rate is lower than the second refresh rate.

Optionally, the first setting module includes a first sending sub-module configured to cause a processor to send to a display chip a refresh rate setting instruction corresponding to the i-th row if the grayscale values of all the pixels in the i-th row are lower than the predetermined value, and a first setting sub-module configured to cause the display chip to set the refresh rate of the i-th row to the first refresh rate in response to the refresh rate setting instruction.

The first setting module may be further configured to cause a display chip to set a refresh rate of an i-th row in the displayed content to a first refresh rate when the grayscale values of the selected pixels in the i-th row are lower than the predetermined value. The acquiring module is further configured to re-acquire a pixel grayscale value of each row in the displayed content on the liquid crystal panel if the content has changed.

The device further includes a mode acquiring module configured to acquire a current display mode. A display mode may include a static display mode and a dynamic display mode. The static display mode is a display mode in which the displayed content remains unchanged for a predetermined period of time, and the dynamic display mode is a display mode in which the displayed content is changed within the predetermined period of time. The acquiring module may be further configured to acquire a pixel grayscale value of each row in the displayed content on the liquid crystal panel if the current display mode is in the static display mode.

According to a third aspect of the present disclosure, there is provided a liquid crystal display device, including a processor, a display chip coupled to the processor, and a memory storing instructions executable by the processor. The processor or the display chip is configured to acquire pixel grayscale values of each row in a displayed content on a liquid crystal panel, determine whether the pixel grayscale values of the selected pixels in an i-th row of the displayed content are lower than a predetermined value, set a refresh rate of the i-th row of the displayed content to a first refresh rate when the pixel grayscale values of the selected pixels of the i-th row are lower than the predetermined value, determine whether at least one pixel grayscale value of the pixels in a j-th row is not lower than the predetermined value, and set a refresh rate of the j-th row in the displayed content to a second refresh rate when the at least one grayscale value of the pixels in the j-th row are not lower than the predetermined value. The first refresh rate is lower than the second refresh rate.

According to a fourth aspect of the embodiments of the present disclosure, there is provided a non-transitory computer-readable storage medium having stored therein instructions that, when executed by a processor of a terminal, causes the terminal to perform a liquid crystal display method, the method including acquiring a pixel grayscale value of each row in a displayed content on a liquid crystal panel, determining whether the pixel grayscale values of the selected pixels in an i-th row of the displayed content are lower than a predetermined value, setting a refresh rate of an i-th row in the displayed content to a first refresh rate if the grayscale values of the selected pixels in the i-th row are lower than a predetermined value, determining whether at least one pixel grayscale value of the pixels in a j-th row is not lower than the predetermined value, and setting a refresh rate of the j-th row in the displayed content to a second refresh rate when at least one grayscale value of the pixels in the j-th row is not lower than the predetermined value. The first refresh rate is lower than the second refresh rate.

The technical solution provided by the embodiments of the present disclosure may have the following advantageous effects. By acquiring a pixel grayscale value of each row in a displayed content on a liquid crystal panel, setting a refresh rate of an i-th row in the displayed content to a first refresh rate if the grayscale values of the pixels in the i-th row are lower than a predetermined value, and setting a refresh rate of a j-th row in the displayed content to a second refresh rate if there is one grayscale value of the pixels in the j-th row are not lower than a predetermined value, the present disclosure solves a technical problem in the related arts where the power consumed by terminals is reduced by merely decreasing the power drained by the backlight. According to the present disclosure, different refresh rates can be set for brighter and darker rows in a displayed content, which can reduce the power consumption of the liquid crystal panel and further reduce the power consumption of the terminal.

It is to be understood that both the foregoing general description and the following detailed description are exemplary only and are not restrictive of the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise presented. The embodiments set forth in the following description of exemplary embodiments do not represent all embodiments consistent with the invention. Instead, they are merely examples of apparatuses and methods consistent with aspects related to the invention as recited in the appended claims.

Figure 1:
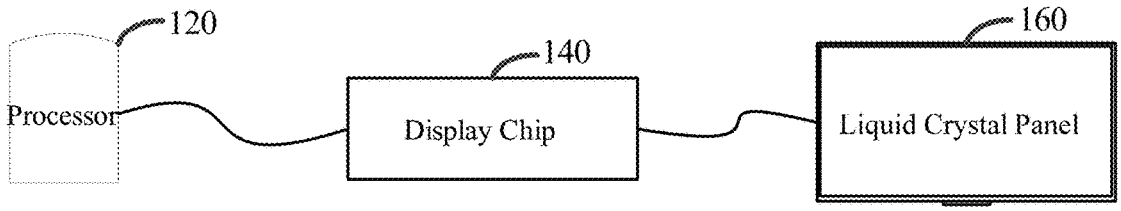
FIG. 1 is a schematic drawing showing a terminal according to embodiments of the present disclosure.

FIG. 1 is a schematic drawing showing a terminal according to various embodiments of the present disclosure. The terminal comprises: a processor 120, a display chip 140, and a liquid crystal panel 160. The terminal may be a smart handset, a smart TV, a tablet, an ebook reader, a MP3 (Moving Picture Experts Group Audio Layer III) or MP4 (Moving Picture Experts Group Audio Layer IV) player, a laptop computer, such as a photo camera, a video camera, or the like.

The processor 120 may be an application processor or a graphic processor. Further details on the processor 120 are described below in reference to FIG. 12. The display chip 140 may comprise a DDIC (Display Driver Integrated Circuit), and control contents displayed on the liquid crystal panel 160. The liquid crystal panel 160 can display contents according to the control of the display chip 140. Normally, the display chip 140 refreshes the liquid crystal panel 160 at a predetermined refresh rate of, e.g., 60 Hz.

Figure 2:
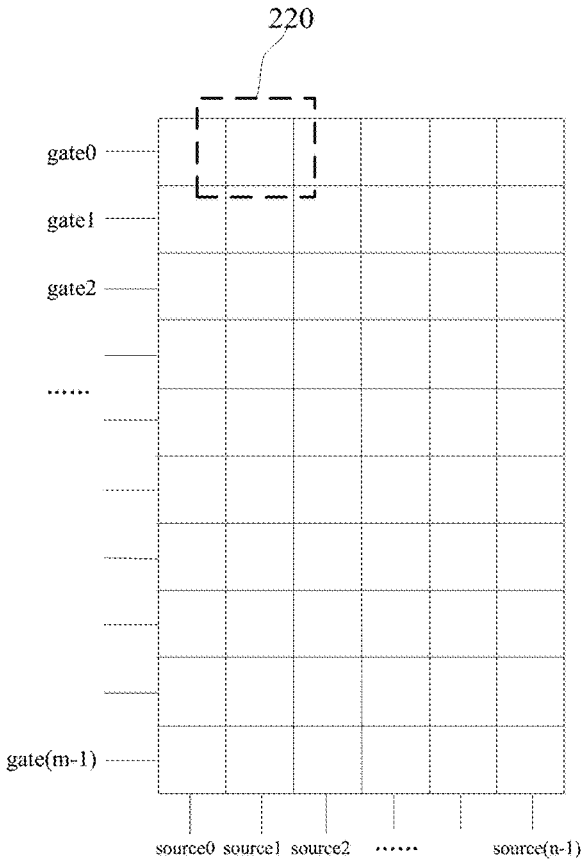
FIG. 2 is a schematic drawing showing an arrangement of liquid crystal cells according to embodiments of the present disclosure.

FIG. 2 is a structure schematic diagram showing a liquid crystal panel 160 according to embodiments of the present disclosure. The liquid crystal panel 160 comprises: m scan lines, i.e., gate0 through gate(m−1); n data lines, i.e., source0 through source(n−1); and m*n liquid crystal cells 220. The liquid crystal cells 220 are arranged in an array of m rows and n columns, with each liquid crystal cell 220 standing for one pixel.

The display chip is connected respectively to the m scan lines and the n data lines. Each scan line is connected to a row of n liquid crystal cells 220, and each data line is connected to a column of m liquid crystal cells 220, while each liquid crystal cell 220 is connected to a scan line and a data line.

When a content is displayed, the display chip 140 sends a scan signal to the first scan line gate0 so as to set the liquid crystal cells 220 of the first row to be in an operation mode. Meanwhile, the display chip also stores the pixel grayscale values corresponding to the liquid crystal cells 220 of the first row through the data lines source0-source(n−1) into the liquid crystal cells 220. Then, the display chip moves on to the second scan line gate1, with the pixel grayscale values of the liquid crystal cells 220 in the second row being stored into the liquid crystal cells 220 in the same way through the data lines source0-source(n−1). This process continues until a scan signal is sent to the last scan line gate(m−1) by the display chip, with the grayscale values being stored to the liquid crystal cells 220 in the last row, which marks the completion of refreshing the displayed content by the display chip 140. The display chip 140 performs such refreshing at a certain frequency, namely the refresh rate of the liquid crystal panel 160, which is often at 50 Hz or 60 Hz or 144 Hz etc.

Figure 3:
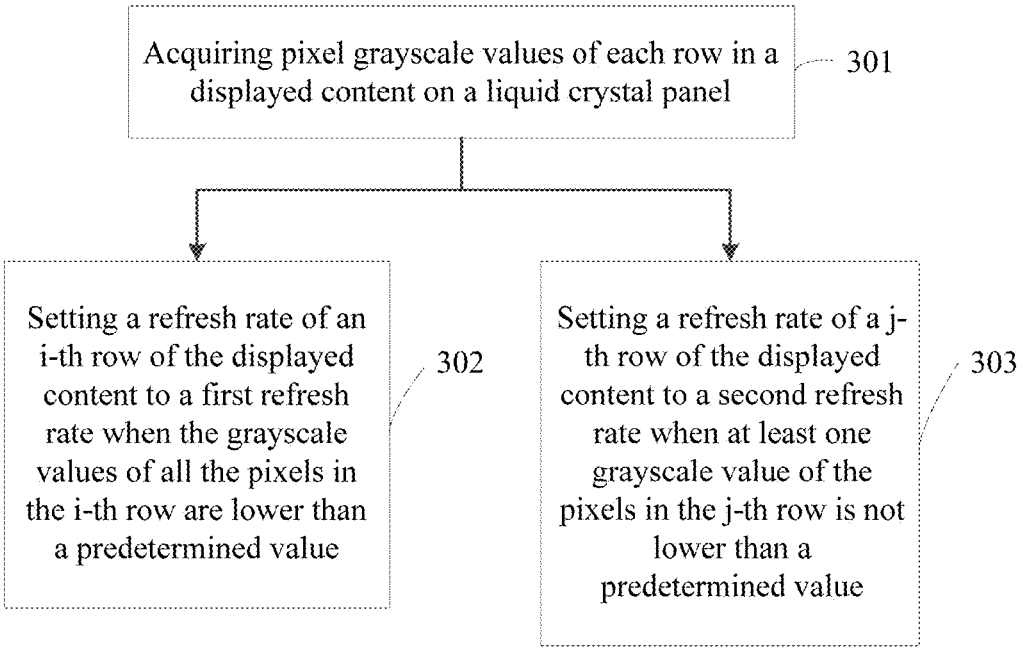
FIG. 3 is a flow chart showing a liquid crystal display method according to an exemplary embodiment.

FIG. 3 is a flow chart showing a liquid crystal display method according to an exemplary embodiment embodying the liquid crystal display method in a terminal shown in FIG. 1 by way of example. The method may comprise the following steps.

In Step 301, pixel grayscale values of pixels in each row of a displayed content on a liquid crystal panel are acquired.

The displayed content is a frame content represented on the m by n liquid crystal cells on the liquid crystal panel 160. The displayed content may include m by n pixels, each with a respective grayscale value. The grayscale value may be within the range of 0-255, where 0 corresponds to black and 255 corresponds to white. In one embodiment, pixel grayscale values of pixels in selected rows of a displayed content on a liquid crystal panel are acquired. For example, pixel grayscale values of every other row in a displayed content on a liquid crystal panel are acquired. Optionally, the displayed content may be an image frame, a video frame, a user interface, etc.

In Step 302, a refresh rate of an i-th row in the displayed content is set to a first refresh rate if the grayscale values of the pixels in the i-th display row are lower than a predetermined value.

In Step 303, a refresh rate of a j-th row in the displayed content is set to a second refresh rate if the grayscale value of any of the pixels in the j-th row is not lower than the predetermined value. The i and j are different integers, and the first refresh rate is lower than the second refresh rate.

Since a row of pixels with very low grayscale values will be shown as (or almost as) black, the row's fresh rate can be decreased without spoiling the row's perceived visual quality. Therefore, if all the pixel grayscale values of the i-th row are lower than the predetermined value, the refresh rate of the i-th row can be decreased to a lower first refresh rate. In one embodiment, if the pixel grayscale values of selected pixels of the i-th row are lower than the predetermined value, the refresh rate of the i-th row can be decreased to a lower first refresh rate. For example, if the pixel grayscale values of every other pixel of the i-th row are lower than the predetermined value, the refresh rate of the i-th row can be decreased to a lower first refresh rate.

The second refresh rate can be a default rate of, e.g., 50 Hz, 60 Hz or 144 Hz, and the first refresh rate is a rate of, e.g., 1 Hz, 2 Hz or 5 Hz etc. lower than the second refresh rate.

It should be noted that the above step 302 and step 303 do not have to be performed in any particular order.

In this manner, the liquid crystal display method provided in this embodiment of the present disclosure acquires a pixel grayscale value of each row in the displayed content on the liquid crystal panel, sets a refresh rate of an i-th row in the displayed content to a first refresh rate if the grayscale values of the pixels in the i-th row are lower than a predetermined value, and sets a refresh rate of a j-th row in the displayed content to a second refresh rate if the grayscale value of any of the pixels in the j-th row is not lower than the predetermined value. The first refresh rate is lower than the second refresh rate. In this regard, the present disclosure solves a technical problem in the related arts where the power consumed by terminals is reduced by merely decreasing the power drained by the backlight. According to the present disclosure, different refresh rates can be set respectively for brighter and darker rows in a displayed content, which can reduce the power consumption of the liquid crystal panel and display chip in a terminal and further reduce the power consumption of the terminal.

Figure 4:
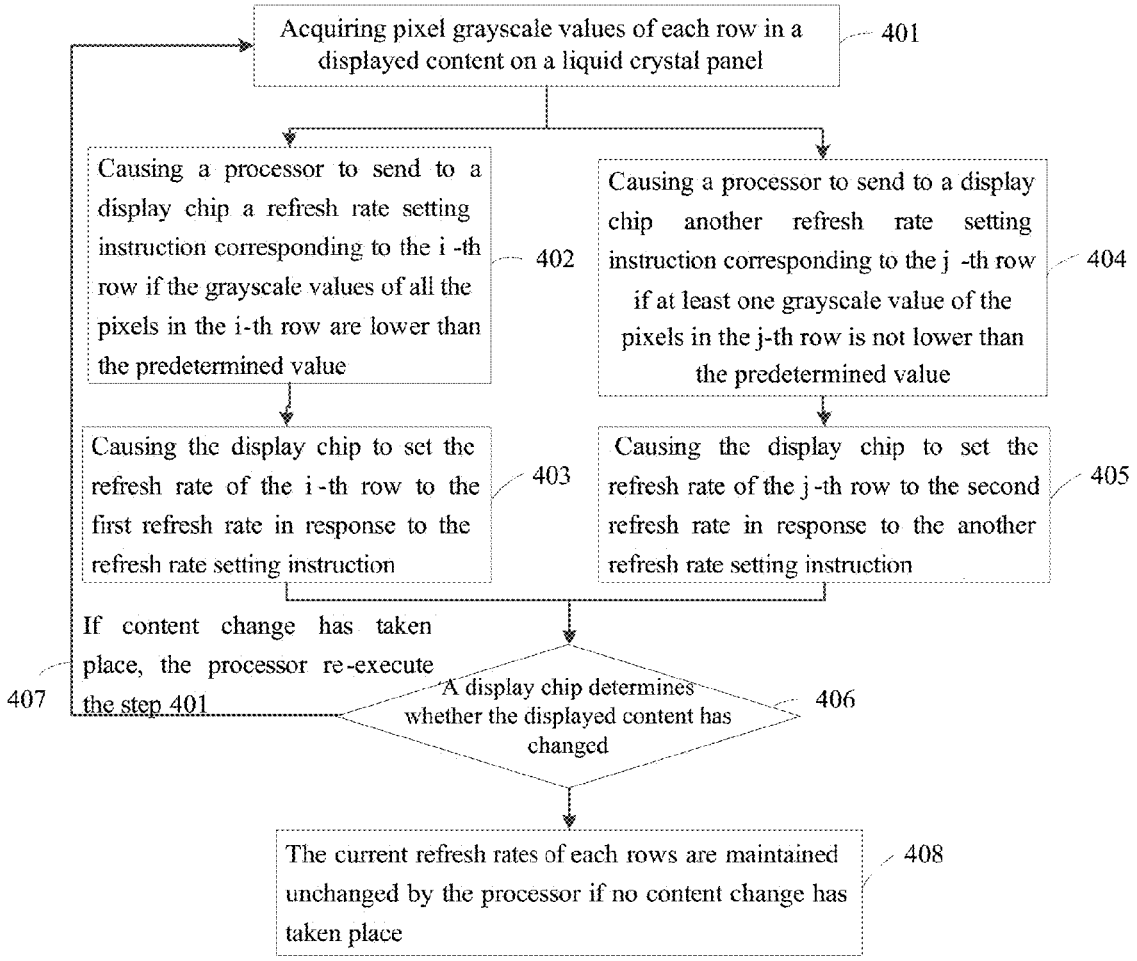
FIG. 4 is a flow chart showing a liquid crystal display method according to another exemplary embodiment.

In the above embodiment, the step 301, step 302 and step 303 may be performed by a processor, which corresponds to the embodiment shown in FIG. 4. The step 301, step 302 and step 303 may also be performed by a display chip, which corresponds to the embodiment shown in FIG. 5.

FIG. 4 is a flow chart showing a liquid crystal display method according to another exemplary embodiment embodying said liquid crystal display method in a terminal as shown in FIG. 1 by way of example.

In Step 401, a pixel grayscale value of each row in the displayed content on the liquid crystal panel is acquired.

Each row in the displayed content on the liquid crystal panel may include n pixels, and each pixel may include three subpixels of red, green and blue. Both m and n are positive integers.

For example, when the liquid crystal panel is embodied in an 8-bit panel, each of its subpixels will be assigned 256 luminance levels, i.e., grayscale values. The color of a pixel is a combination of three subpixels colored in red, green or blue of various grayscale values, and lower grayscale values will produce a darker pixel.

In other example, the liquid crystal panel may be a 10-bit panel or higher, where each subpixels are assigned more luminance levels.

A processor may be configured to acquire each pixel grayscale values of a row in a displayed content. Each pixel grayscale value may include the grayscale values of the three components of the red, green and blue. Optionally, for each pixel, the highest value Q of the grayscale values of the three components may be chosen by the processor as the grayscale value of the pixel.

The above process may be used for acquiring the grayscale values of each pixels of the m rows in the displayed content on the liquid crystal panel. For each refresh process, the processor may start the above process from the first row, move on to the next, and continue until the last row.

The processor may determine if all the pixel grayscale values of a row in a displayed content are lower than a predetermined value. The predetermined value is a grayscale value corresponding to (or nearly to) black, which can be, e.g., 0 or 5 etc. The predetermined value may be any reasonable threshold preset on the terminal or customized by a user, which will not be limited in this disclosure.

In Step 402, a processor sends to a display chip a refresh rate setting instruction corresponding to the i-th row if the grayscale values of all the pixels in the i-th row are lower than a predetermined value.

The processor sends a refresh rate setting instruction to a display chip if the processor determines that all the pixel grayscale values of the i-th row are lower than a predetermined value. The processor may skip sending the refresh rate setting instruction if the i-th row is already at the first refresh rate.

In Step 403, the display chip sets the refresh rate of the i-th row to the first refresh rate in response to the refresh rate setting instruction.

Receiving from a processor a refresh rate setting instruction, the display chip sets the refresh rate of the i-th row to the first refresh rate. For example, the first refresh rate may be 1 Hz.

In Step 404, a processor sends to a display chip a refresh rate setting instruction corresponding to the j-th row if the grayscale value of any of the pixels of the j-th row in the displayed content is not lower than the predetermined value.

The processor sends another refresh rate setting instruction to a display chip if the processor determines that at least one of the pixel grayscale values of the j-th row is not lower than a predetermined value. The processor may skip sending said another refresh rate setting instruction if the j-th row is already at the second refresh rate.

In Step 405, the display chip sets the refresh rate of the j-th row to the second refresh rate in response to the second refresh rate setting instruction. The first refresh rate is lower than the second refresh rate.

Receiving from a processor said another refresh rate setting instruction, the display chip sets the refresh rate of the j-th row to the second refresh rate. For example, the second refresh rate may be 60 Hz.

The first refresh rate is lower than the second refresh rate. For example, the first refresh rate is 1 Hz, and the second refresh rate is 60 Hz.

It should be noted that the above step 402 and step 404 do not have to be performed in any particular order.

In step 406, a processor determines whether the displayed content has changed.

When the display chip generates displayed contents at a frame rate lower than the refresh rate of the liquid crystal panel, the processor determines that no content change has taken place if the displayed content of the current frame and that of the previous frame are the same. But if the content in the current frame is different from that of the previous frame, the processor determines that the displayed content has changed.

At step 407, if content change has taken place, the processor again acquires a pixel grayscale value of each row in the displayed content on the liquid crystal panel as in step 401.

In an implementation, when content change is detected, the processor begins acquiring a pixel grayscale value of each row in a displayed content, and re-sends the refresh rate setting instruction.

In another implementation, when content change is detected, the processor determines which rows have changed. For those rows with changed content, the processor re-executes step 401 to acquire a pixel grayscale value, and re-sends the refresh rate setting instruction. For those rows with unchanged content, their refresh rates are left unchanged as well.

At step 408, the current refresh rate of each rows are maintained unchanged by the processor if no content change has taken place.

It should be noted that the said "i" and "j" do not indicate anything particular, and could be used to refer to any row in a displayed content.

In this manner, the liquid crystal display method provided in this embodiment of the present disclosure acquires a pixel grayscale value of each row in a displayed content on a liquid crystal panel, sets a refresh rate of an i-th row in the displayed content to a first refresh rate if the grayscale values of all the pixels in the i-th row are lower than a predetermined value, and sets a refresh rate of a j-th row in the displayed content to a second refresh rate if at least one grayscale value of the pixels in the j-th row is not lower than a predetermined value. The present disclosure solves a technical problem in the related arts where the power consumed by terminals is reduced by merely decreasing the power drained by the backlight, and different refresh rates can be set respectively for brighter and darker rows in a displayed content, which can reduce the power consumption of the liquid crystal panel and display chip in a terminal and further reduce the power consumption of the terminal.

In this manner, the method provided in this embodiment of the present disclosure sets a lower refresh rate for darker rows in a displayed content while setting a higher refresh rate for brighter rows, thereby reducing energy consumed by the terminal without noticeably spoiling the expected visual quality and maintaining the normally display effect.

Figure 5:
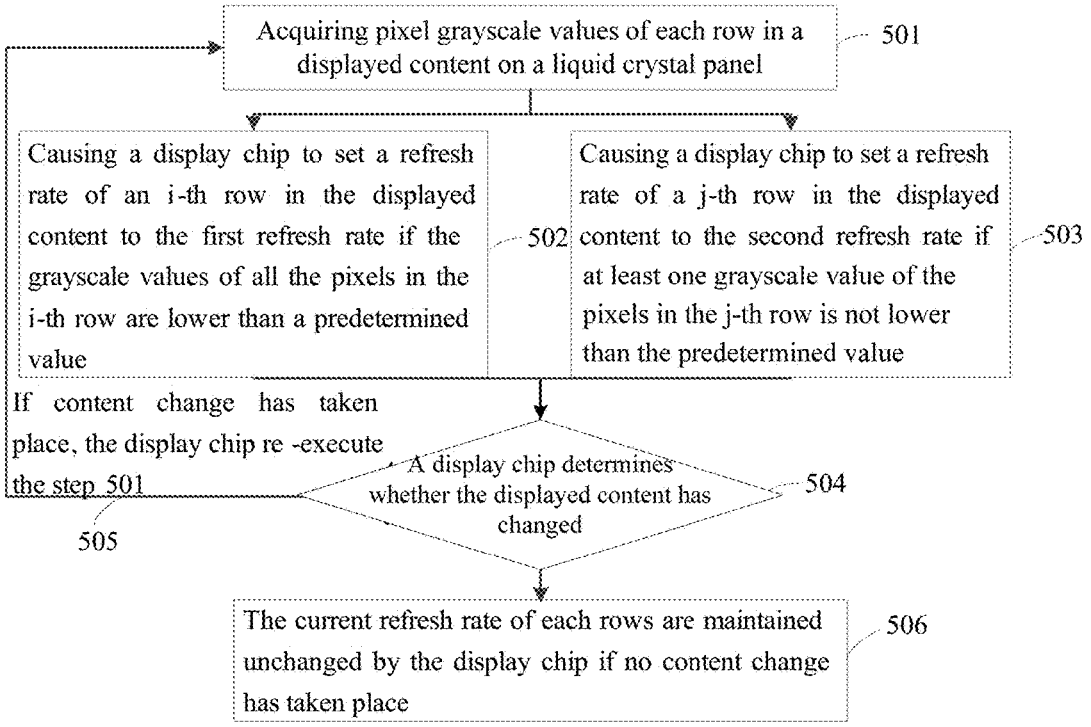
FIG. 5 is a flow chart showing a liquid crystal display method according to yet another exemplary embodiment.

FIG. 5 is a flow chart showing a liquid crystal display method according to yet another exemplary embodiment embodying said liquid crystal display method in a terminal as shown in FIG. 1 by way of example.

In Step 501, a pixel grayscale value of each row in the displayed content on the liquid crystal panel is acquired.

Each row in the displayed content on the liquid crystal panel may include n pixels, each pixel including three subpixels of red, green and blue.

For example, when the liquid crystal panel is embodied in an 8-bit panel, each of its subpixels will be assigned 256 luminance levels, i.e., grayscale values. The color of a pixel is a combination of three subpixels colored in red, green or blue of various grayscale values, and lower grayscale values will produce a darker pixel.

Optionally, the liquid crystal panel may also be a 10-bit panel or higher, where each subpixels are assigned more luminance levels.

A display chip may be used for acquiring each pixel gray scale values of a row in a displayed content. Each pixel grayscale value comprises the grayscale values of the three components of the red, green and blue. Optionally, for each pixel, the highest value Q of the grayscale values of the three components is chosen by the display chip as the grayscale value of the pixel.

The above process can be used for acquiring the grayscale values of each pixels of the m rows in the displayed content on the liquid crystal panel.

The display chip determines whether all the pixel grayscale values of a row in a displayed content are lower than a predetermined value. The predetermined value is a grayscale value corresponding to (or nearly to) black, which can be, e.g., 0 or 5 etc. The predetermined value may be any reasonable threshold preset on the terminal or customized by a user, which will not be limited in this disclosure.

In Step 502, a display chip sets a refresh rate of an i-th row in the displayed content to a first refresh rate if the grayscale values of the pixels in the i-th row are lower than the predetermined value.

The display chip sets the refresh rate of the i-th row in the displayed content to a first refresh rate if the grayscale values of the pixels in the i-th row are lower than a predetermined value. The display chip may skip changing the refresh rate if the i-th row is already at the first refresh rate.

In Step 503, a display chip sets a refresh rate of a j-th display row in the displayed content to a second refresh rate if at least one grayscale value of one of the pixels in the j-th display row is not lower than the predetermined value. The first refresh rate is lower than the second refresh rate.

The display chip sets the refresh rate of the j-th row to the second refresh rate if the display chip determines that at least one grayscale value of one of the pixels of the j-th row is not lower than the predetermined value. The display chip can skip changing the refresh rate if the j-th row is already at the second refresh rate.

Here, the first refresh rate is lower than the second refresh rate. For example, the first refresh rate is 1 Hz, and the second refresh rate is 60 Hz.

It should be noted that said step 502 and step 503 do not have to be performed in any particular order.

At step 504, a display chip determines if the displayed content has changed.

When the display chip generates displayed contents at a frame rate lower than the refresh rate of the liquid crystal panel, the display chip determines that no content change has taken place if the displayed content of the current frame and that of the previous frame are the same. But if the content in the current frame is different from that of the previous frame, the display chip determines that the displayed content has change.

At step 505, if content change has taken place, the display chip re-acquires a pixel grayscale value of each row in the displayed content on the liquid crystal panel.

In an implementation, when content change is detected, the display chip begins acquiring a pixel grayscale value of each row in a displayed content, and sends the refresh rate setting instruction.

In another implementation, when content change is detected, the display chip detects which rows have changed. For those rows with changed content, the display chip re-executes the step 501 to acquire a pixel grayscale value, and sets the refresh rate setting instruction. For those rows with unchanged content, their refresh rates are left unchanged as well.

At step 506, the current refresh rate of each rows are maintained by the display chip if no content change has taken place.

In this manner, the liquid crystal display method provided in this embodiment of the present disclosure acquires a pixel grayscale value of each row in a displayed content on a liquid crystal panel, sets a refresh rate of an i-th row in the displayed content to a first refresh rate if the grayscale values of all the pixels in the i-th row are lower than a predetermined value, and sets a refresh rate of a j-th row in the displayed content to a second refresh rate if at least one grayscale value of the pixels in the j-th row is not lower than a predetermined value. The first refresh rate is lower than the second refresh rate, thereby solving a technical problem in the related arts where the power consumed by terminals is reduced by merely decreasing the power drained by the backlight, and different refresh rates can be set respectively for brighter and darker rows in a displayed content, which can reduce the power consumption of the liquid crystal panel and display chip in a terminal and further reduce the power consumption of the terminal.

In this manner, the method provided in this embodiment of the present disclosure sets a lower refresh rate for darker rows in a displayed content while setting a higher refresh rate for brighter rows, thereby reducing energy consumed by the terminal without noticeably spoiling the expected visual quality and maintaining the normally display effect.

In this manner, the method provided in this embodiment of the present disclosure can reduce processor payload by enabling a display chip to determine whether the pixel grayscale values are lower than a predetermined value.

Figure 6:
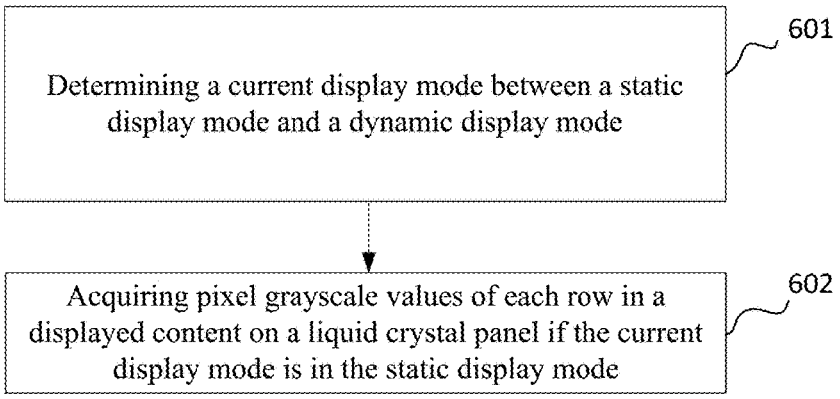
FIG. 6 is a flow chart showing a liquid crystal display method according to yet another exemplary embodiment.

In alternative embodiments based on those shown in FIG. 4 and FIG. 5, other steps may be involved before the step 401 and step 501. Optionally, as shown in FIG. 6, the method can further comprise a step 601 and a step 602.

In Step 601, a current display mode is determined between a static display mode and a dynamic display mode. The static display mode is a display mode in which the displayed content remains unchanged for a predetermined period of time. The dynamic display mode is a display mode in which the displayed content is changed within the predetermined period of time.

A current display mode is the display mode to which the currently displayed content corresponds. There are many ways to acquire the current display mode.

In an implementation, a processor can determine the current display mode by referring to a currently displayed scene. A statically displayed scene where the change frequency of the displayed content is low can be determined by the processor to be in a static display mode, while a dynamically displayed scene where content change is frequent can be determined by the processor to be in dynamic display mode. For example, a video is a dynamically displayed scene and it can be determined to be in the dynamic display mode when the processor detects a video being played. In contrast, a locked screen is a statically displayed scene and it can be determined to be in a static display mode when the processor detects the locked screen.

A displayed scene can be pre-classified by a user as either a static scene or a dynamic scene.

In another implementation, a processor can acquire the content of the current frame and neighboring frame from the display buffer to determine if graphic data of the current frame and its neighboring frame are identical. The display mode can be determined as static if they are identical, or dynamic if they are not.

The current display mode can be acquired by the processor through other means, and the predetermined period of time may be of any reasonable span preset on the terminal or customized by a user, and neither of which will be limited in this disclosure.

Optionally, the processor periodically determines the current display mode at an interval of T, which will not be limited in this disclosure.

In Step 602, a pixel grayscale value of each row in a displayed content on a liquid crystal panel is acquired if the current display mode is in the static display mode.

When it is determined that the current display mode is the static display mode, the processor expects the currently displayed content to remain unchanged for a predetermined period of time, and begins acquiring a pixel grayscale value of each row in the displayed content on the liquid crystal panel.

The processor may leave the refresh rate of the liquid crystal panel unchanged if it is determined that the current display mode is the dynamic display mode.

In a specific embodiment, the terminal is embodied in an electronic album, with the displayed content being an image frame. The displayed content on the liquid crystal panel is periodically updated by a new image frame every 5 seconds. Assuming different image frames are designated respectively as Frame1, Frame2, etc., and the content initially displayed is Frame1.

Figure 7:
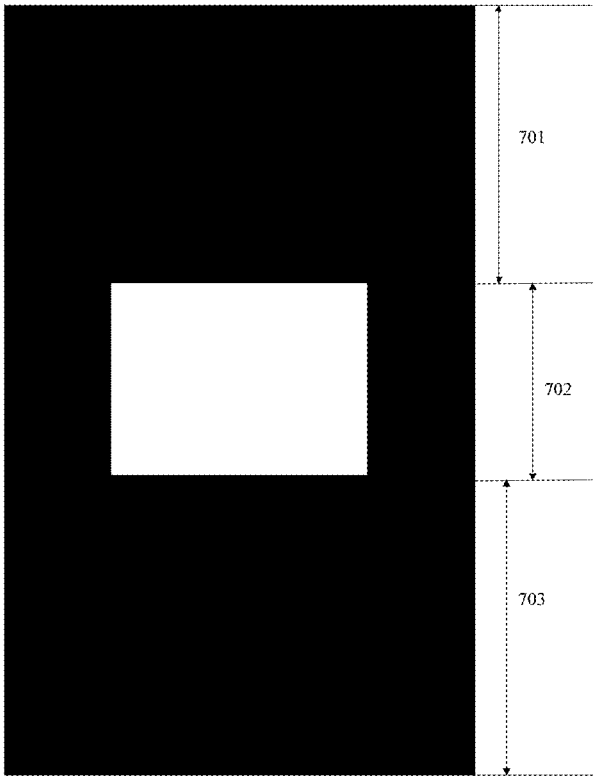
FIG. 7 is a schematic diagram showing a displayed content according to an exemplary embodiment.

As shown in FIG. 7, a displayed content is represented by 20*15 pixels, with the 701 indicating rows 1-8, the 702 indicating rows 9-13, and the 703 indicating rows 14-20.

Since the current display mode acquired by the processor is in static display mode, the processor begins acquiring grayscale values of the 15 pixels in row 1 of the displayed content. Assuming the predetermined value is five, and the acquired grayscale values of the 15 pixels in row 1 are all zero. Because all of the grayscale values of the 15 pixels are lower than the predetermined value, i.e., 5, it can be determined that the content of the row 1 is in black, hence the refresh rate of the row 1 is set to a first refresh rate 1 Hz. Similarly, the refresh rates of the rows 2-8 are all set to the first refresh rate 1 Hz. When pixel grayscale values in row 9 are acquired, eight of the pixels are discovered to be having a grayscale value of 255. Since they are lager the predetermined value, the refresh rate of the row 9 is set to a second refresh rate 60 Hz. Similarly, the refresh rates of the rows 10-13 are all set to the second refresh rate. When the pixel grayscale values of row 14 are acquired, all of the grayscale values of the 15 pixels are lower than the predetermined value, so the refresh rate of the row 14 is set to the first refresh rate 1 Hz. Similarly, the refresh rate of the rows 15-20 are all set to the first refresh rate.

Because the displayed content is expected to remain being Frame1 for the next 5 seconds, the above refresh rate settings will remain unchanged, too. That is, the refresh rates of pixels of rows 1-8 and 14-20 are to remain at the first refresh rate 1 Hz, while that of pixels of rows 9-13 are to remain at the second refresh rate 1 Hz. When the displayed content Frame1 is changed to Frame2, a pixel grayscale value of each row will be re-acquired and the refresh rate of each rows will be reset.

Figure 8:
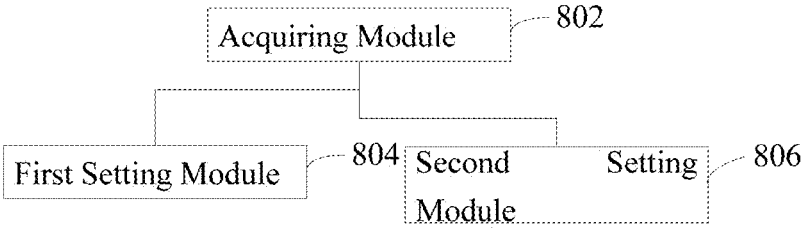
FIG. 8 is a block diagram showing a liquid crystal display device according to an exemplary embodiment.

FIG. 8 is a block diagram showing a liquid crystal display device according to an exemplary embodiment embodying said liquid crystal display method in a terminal as shown in FIG. 1 by way of example. The device includes an acquiring module 802, a first setting module 804, and a second setting module 806.

The acquiring module 802 is configured to acquire a pixel grayscale value of each row in a displayed content on a liquid crystal panel. The first setting module 804 is configured to set a refresh rate of an i-th row in the displayed content to a first refresh rate if the grayscale values of the pixels in the i-th row are lower than a predetermined value. The second setting module 806 is configured to set a refresh rate of a j-th row in the displayed content to a second refresh rate if at least one grayscale value of any of the pixels in the j-th row is not lower than the predetermined value. The first refresh rate is lower than the second refresh rate.

In this manner, the liquid crystal display device provided in this embodiment of the present disclosure acquires a pixel grayscale value of each row in a displayed content on a liquid crystal panel, sets a refresh rate of an i-th row in the displayed content to a first refresh rate if the grayscale values of the pixels in the i-th display row are lower than a predetermined value, and sets a refresh rate of a j-th row in the displayed content to a second refresh rate if at least one grayscale value of any of the pixels in the j-th row is not lower than a predetermined value. The first refresh rate is lower than the second refresh rate. The present disclosure solves a technical problem in the related arts where the power consumed by terminals is reduced by merely decreasing the power drained by the backlight, and different refresh rates can be set respectively for brighter and darker rows in a displayed content, which can reduce the power consumption of the liquid crystal panel and display chip in a terminal and further reduce the power consumption of the terminal.

Figure 9:
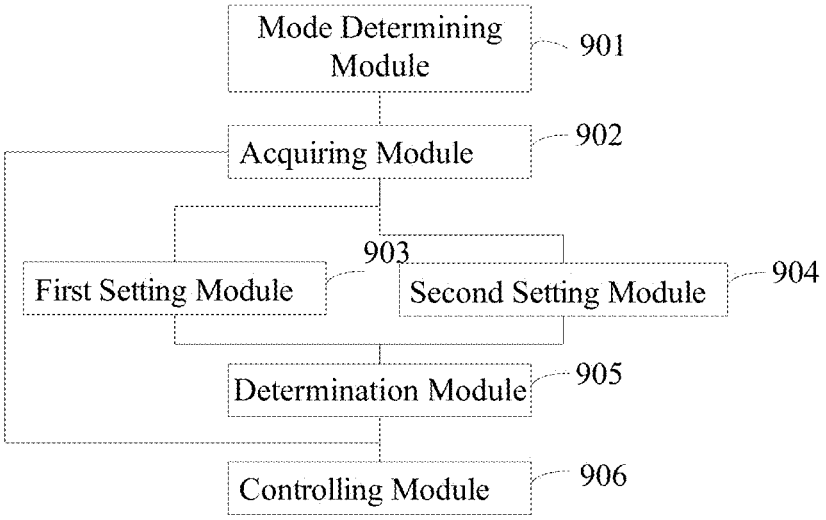
FIG. 9 is a block diagram showing a liquid crystal display device according to another exemplary embodiment.

FIG. 9 is a block diagram showing a liquid crystal display device according to another exemplary embodiment embodying said liquid crystal display method in a terminal as shown in FIG. 1 by way of example. The device includes a mode determining module 901, an acquiring module 902, and a first setting module 903.

The mode determining module 901 is configured to determine a current display mode. A display mode may be a static display mode and a dynamic display mode. The static display mode is a display mode in which the displayed content remains unchanged for a predetermined period of time, and the dynamic display mode is a display mode in which the displayed content is changed within the predetermined period of time.

The acquiring module 902 is configured to acquire a pixel grayscale value of each row in a displayed content on a liquid crystal panel if the current display mode is in the static display mode. The acquiring module 902 is further configured to re-acquire a pixel grayscale value of each row in the displayed content on the liquid crystal panel if the displayed content has changed.

The first setting module 903 is configured to set a refresh rate of an i-th row in the displayed content to the first refresh rate if the grayscale values of the pixels in the i-th row are lower than the predetermined value. The first setting module 903 can be realized through any of two optional implementations.

Figure 10:
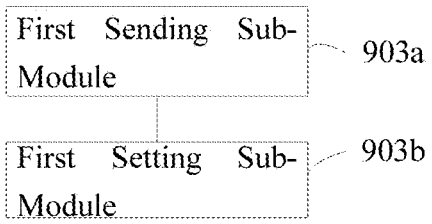
FIG. 10 is a block diagram showing a liquid crystal display device according to yet another exemplary embodiment.

In a first implementation, the first setting module 903 is embodied with a processor and a display chip together, and comprises a first sending sub-module 903*a* and a first setting sub-module 903*b*, as shown in FIG. 10.

The first sending sub-module 903*a* is configured to cause a processor to send to a display chip a refresh rate setting instruction corresponding to the i-th row if the grayscale values of the pixels in the i-th row are lower than the predetermined value. The first setting sub-module 903*b* is configured to cause the display chip to set the refresh rate of the i-th row to the first refresh rate in response to the refresh rate setting instruction.

In a second implementation, the first setting module 903 is embodied with a display chip alone, and is in particular configured to cause a display chip to set a refresh rate of an i-th row in the displayed content to a first refresh rate if the grayscale values of the pixels in the i-th row are lower than the predetermined value.

A second setting module 904 is configured to set a refresh rate of a j-th row in the displayed content to a second refresh rate if at least one grayscale value of the pixels in the j-th row is not lower than the predetermined value. The first refresh rate is lower than the second refresh rate.

The second setting module 904 can also be realized through two optional implementations corresponding to that of the first setting module 903.

Figure 11:
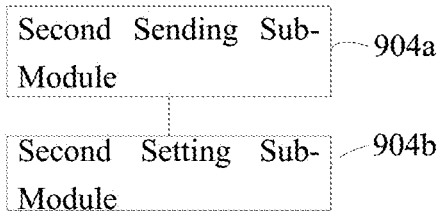
FIG. 11 is a block diagram showing a liquid crystal display device according to yet another exemplary embodiment.

If the first setting module 903 is realized through said first implementation, the second setting module will correspondingly be embodied with a processor and a display chip together, and includes a second sending sub-module 904*a* and a second setting sub-module 905*b*, as shown in FIG. 11.

The second sending sub-module 904*a* is configured to cause a processor to send to a display chip a second refresh rate setting instruction corresponding to the j-th row if at least one grayscale value of the pixels in the j-th row is not lower than the predetermined value. The second setting sub-module 904*b* is configured to cause the display chip to set the refresh rate of the j-th row to a second refresh rate in respond to the refresh rate setting instruction. The first refresh rate is lower than the second refresh rate.

If the first setting module 903 is realized through said second implementation, the second setting module will correspondingly be embodied in a display chip alone, and particularly, be configured to cause the display chip to set a refresh rate of a j-th row in the displayed content to a second refresh rate if at least one grayscale value of the pixels in the j-th row is not lower than the predetermined value. The first refresh rate is lower than the second refresh rate.

A determination module 905 is configured to determine if the displayed content has changed. The determination module 905 can also function through a processor or a display chip.

A controlling module 906 is configured to cause the display chip to maintain the current refresh rate of each row at their current levels if no content change has taken place.

In this manner, the liquid crystal display device provided in this embodiment of the present disclosure acquires a pixel grayscale value of each row in a displayed content on a liquid crystal panel, sets a refresh rate of an i-th row in the displayed content to a first refresh rate if the grayscale values of the pixels in the i-th row are lower than a predetermined value, and sets a refresh rate of a j-th row in the displayed content to a second refresh rate if at least one grayscale value of the pixels in the j-th row is not lower than a predetermined value. The first refresh rate is lower than the second refresh rate. In this regard, the present disclosure solves a technical problem in the related arts where the power consumed by terminals is reduced by merely decreasing the power drained by the backlight, and different refresh rates can be set respectively for brighter and darker rows in a displayed content, which can reduce the power consumption of the liquid crystal panel and display chip in a terminal and further reduce the power consumption of the terminal.

In this manner, the device provided in this embodiment of the present disclosure sets a lower refresh rate for darker rows in a displayed content while setting a higher refresh rate for brighter rows, thereby reducing energy consumed by the terminal without significantly spoiling the expected visual quality and maintaining the normally display effect.

With respect to the device in the above embodiments, the specific manners for performing operations for individual modules therein have been described in detail in the embodiments regarding the related methods, which will not be elaborated herein.

This disclosure also provides an exemplary embodiment of a liquid crystal display device which can implement the liquid crystal display method. The liquid crystal display device includes a processor, a display chip coupled to the processor, and a memory storing instructions executable by the processor. The processor or the display chip is configured to acquire a pixel grayscale value of each row in a displayed content on a liquid crystal panel, set a refresh rate of an i-th row in the displayed content to a first refresh rate if the grayscale values of all the pixels in the i-th row are lower than a predetermined value, and set a refresh rate of a j-th row in the displayed content to a second refresh rate if at least one grayscale value of the pixels in the j-th row is not lower than the predetermined value. The first refresh rate is lower than the second refresh rate.

Optionally, the processor or the display chip is further configured to cause a processor to send to a display chip a refresh rate setting instruction corresponding to the i-th row if the grayscale values of all the pixels in the i-th row are lower than the predetermined value, and cause the display chip to set the refresh rate of the i-th row to the first refresh rate in response to the refresh rate setting instruction.

The processor or the display chip is further configured to re-acquire a pixel grayscale value of each row in the displayed content on the liquid crystal panel if the displayed content has changed.

The processor or the display chip is further configured to acquire a current display mode. A display mode may include a static display mode and a dynamic display mode. The static display mode is a display mode in which the displayed content remains unchanged for a predetermined period of time, and the dynamic display mode is a display mode in which the displayed content is changed within the predetermined period of time. and the processor or the display chip is further configured to acquire a pixel grayscale value of each row in the displayed content on the liquid crystal panel if the current display mode is in the static display mode.

Figure 12:
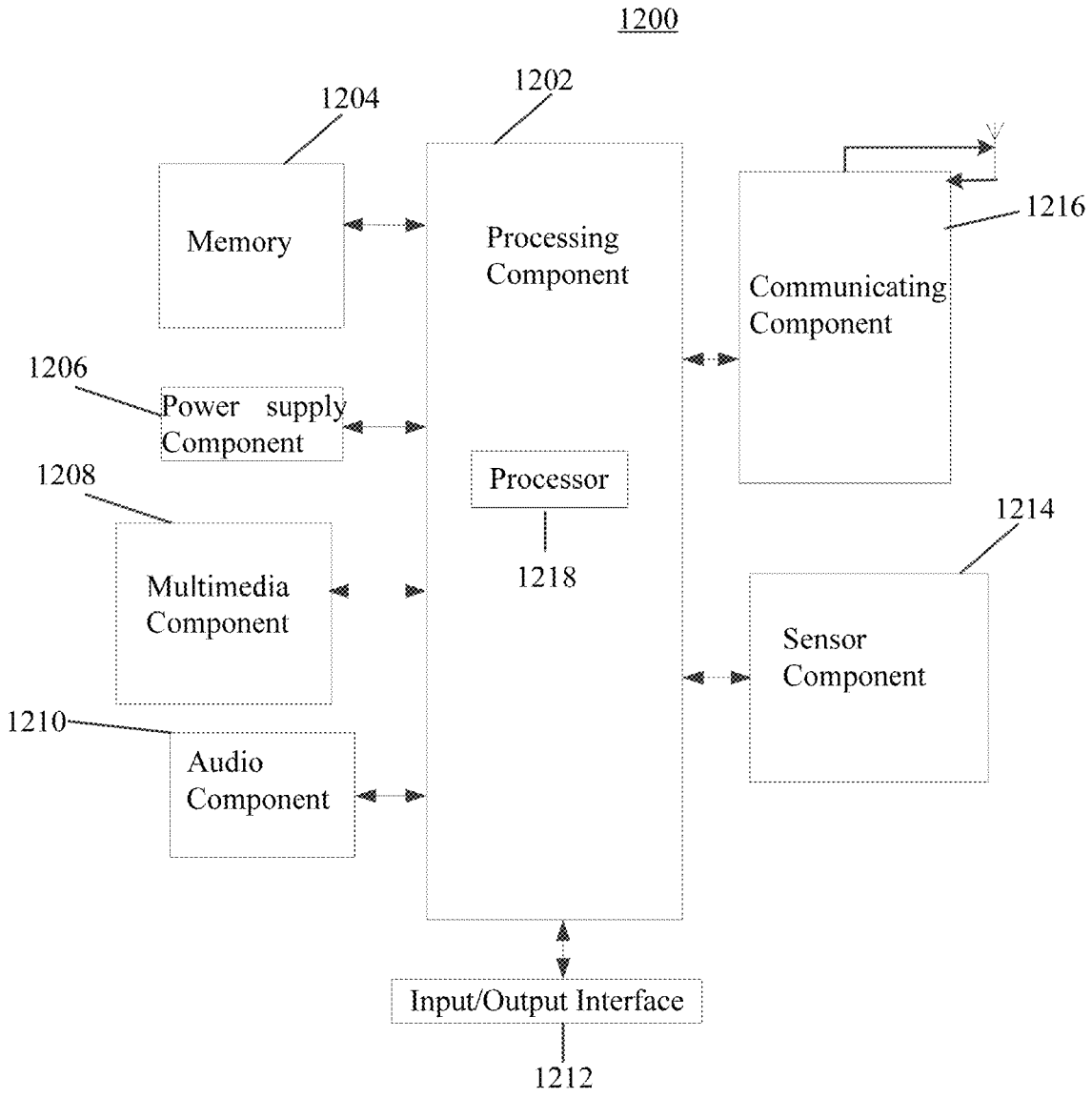
FIG. 12 is a block diagram showing a liquid crystal display device according to yet another exemplary embodiment.

FIG. 12 is a block diagram showing a liquid crystal display device according to yet another exemplary embodiment. For example, the device 1200 may be a mobile phone, a computer, a digital broadcast terminal, a messaging device, a game console, a tablet, a medical device, exercise equipment, a personal digital assistant or the like.

Referring to FIG. 12, the device 1200 may include one or more following components: a processing component 1202, a memory 1204, a power supply component 1206, a multimedia component 1208, an audio component 1210, an input/output (I/O) interface 1212, a sensor component 1214 and a communication component 1216.

The processing component 1202 generally controls the whole operations of the device 1200, for example, the operations associated with display, phone call, data communication, camera operation and record operation. The processing component 1202 may include one or more processors 1218 to execute instructions to perform all or part of the steps in the above described methods. Moreover, the processing component 1202 may include one or more modules which facilitate the interaction between the processing component 1202 and other components. For instance, the processing component 1202 may include a multimedia module to facilitate the interaction between the multimedia component 1208 and the processing component 1202.

The memory 1204 is configured to store various types of data to support the operation performed on the device 1200. Examples of such data include instructions for any applications or methods operated on the apparatus 1200, contact data, phonebook data, messages, pictures, video, etc. The memory 1204 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power supply component 1206 provides power to various components of the device 1200. The power component 1206 may include a power management system, one or more power sources, and any other components associated with the generation, management, and distribution of power in the device 1200.

The multimedia component 1208 includes a screen providing an output interface between the device 1200 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1208 includes one front-facing camera and/or one rear-facing camera. When the device 1200 is under an operation mode, for example, a shooting mode or a video mode, the front-facing camera and/or the rear-facing camera may receive outside multimedia data. Each of the front camera and the rear camera may be a fixed optical lens system or have focus and optical zoom capability.

The audio component 1210 is configured to output and/or input audio signal. For example, the audio component 1210 includes a microphone ("MIC") configured to receive an external audio signal when the device 1200 is in an operation mode, such as a call mode, a recording mode, and a voice recognition mode. The received audio signal may be further stored in the memory 1204 or transmitted via the communication component 1216. In some embodiments, the audio component 1210 further comprises a speaker to output audio signals.

An I/O interface 1212 provides an interface between the processing component 1202 and a peripheral interface module. The above peripheral interface module may be a keyboard, a click wheel, and button, etc. The button may include but not limit to home page button, volume button, start button and lock button.

The sensor component 1214 includes one or more sensors and is configured to provide various aspects of the assessment state for the device 1200. For instance, the sensor component 1214 may detect an open/closed status of the device 1200, relative positioning of components, e.g., the display and the keypad, of the device 1200, a change in position of the device 1200 or a component of the device 1200, a presence or absence of user contact with the device 1200, an orientation or an acceleration/deceleration of the device 1200, and a change in temperature of the device 1200. The sensor component 1214 may include a proximity sensor configured to detect the presence of nearby objects without any physical contact. The sensor component 1214 may also include an optical sensor (such as CMOS or a CCD image sensor) configured to be used in imaging application. In some embodiments, the sensor assembly 1214 may also include an acceleration sensor, a gyro sensor, a magnetic sensor, a pressure sensor or a temperature sensor.

The communication component 1216 is configured to facilitate the wired or wireless communication between the device 1200 and other devices. The device 1200 may access the wireless network based on a communication standard, such as Wi-Fi, 2G or 3G, or a combination thereof. In one exemplary embodiment, the communication component 1216 receives a broadcast information or broadcast associated information from an external broadcast management system via a broadcast channel. In one exemplary embodiment, the communication component 1216 also includes a Near Field Communication (NFC) module to facilitate short-range communication. For example, the NFC module may be based on Radio Frequency Identification (RFID) technology, Infrared Data Association (IrDA) technology, Ultra-Wideband (UWB) technology, Bluetooth (BT) technology and other technologies.

In an exemplary embodiment, the device 1200 may be realized through one or more Application Specific Integrated Circuits (ASIC), a Digital Signal Processor (DSP), a Digital Signal Processing Device (DSPD), a Programmable Logic Device (PLD), a Field Programmable Gate Array (FPGA), a controller, a microcontroller, a microprocessor, or other electronic elements, and configured to carry out the liquid crystal display method described above.

In an exemplary embodiment, a non-transitory computer-readable storage medium comprising the instruction is also provided, for example, the memory 1204 including the instruction. The above instruction may be carried out by the processor 1218 of the device 1200 to complete the above liquid crystal display method. For example, the non-transitory computer-readable storage medium may be a ROM, a random access memory (RAM), a CD-ROM, a magnetic tape, a floppy disk, an optical data storage devices and the like.

Each module discussed above, such as the acquiring module 802, the first setting module 804, the second setting module 806, may take the form of a packaged functional hardware unit designed for use with other components, a portion of a program code (e.g., software or firmware) executable by the processor 1202 or the processing circuitry that usually performs a particular function of related functions, or a self-contained hardware or software component that interfaces with a larger system, for example.

Those skilled in the art may easily conceive other embodiments of the disclosure from consideration of the specification and practice of the disclosure disclosed here. This application is intended to cover any variations, uses, or adaptations of the invention following the general principles thereof and including such departures from the present disclosure as come within known or customary practice in the art. The specification and examples are intended to be exemplary only, with a true scope and spirit of the invention being indicated by the following claims.

It will be appreciated that the present disclosure is not limited to the exact construction that has been described above and illustrated in the accompanying drawings, and that various modifications and changes can be made without departing from the scope thereof. It is intended that the scope of the invention only be limited by the appended claims.

The invention claimed is:

1. A method for displaying content on a liquid crystal panel, comprising:

acquiring pixel grayscale values of all pixels in a row of content displayed on the liquid crystal panel;

determining whether the pixel grayscale values of all the pixels in an i-th row of the displayed content are each lower than a predetermined value;

when it is determined that the pixel grayscale values of all the pixels in the i-th row are each lower than the predetermined value, setting a refresh rate of the i-th row of the displayed content to a first refresh rate without changing any of the pixel grayscale values of all the pixels in the i-th row;

determining whether at least one pixel grayscale value of all the pixels in a j-th row is not lower than the predetermined value; and when it is determined that the at least one pixel grayscale value of all the pixels in the j-th row is not lower than the predetermined value, setting a refresh rate of the j-th row of the displayed content to a second refresh rate without changing any of the pixel grayscale values of all the pixels in the j-th row, wherein the first refresh rate is lower than the second refresh rate.

2. The method according to claim 1, wherein said setting the refresh rate of the i-th row of the content to the first refresh rate comprises:

sending to a display chip a refresh rate setting instruction corresponding to the i-th row in the displayed content.

3. The method according to claim 1, wherein the first refresh rate is less than 50 Hz.

4. The method according to claim 1, wherein the method further comprises:

determining whether the content has changed after setting the refresh rate of the i-th row of the displayed content to the first refresh rate or setting the refresh rate of the j-th row of the displayed content to the second refresh rate; and acquiring a pixel grayscale value of a row of the changed content on the liquid crystal panel when the displayed content has changed.

5. The method according to claim 1, wherein the method further comprises:

determining whether a row of the content has changed; and acquiring pixel grayscale values of pixels of the changed row when the row of the content has changed.

6. The method according to claim 5, wherein the method further comprises:

maintaining a refresh rate for the row when the row of the content has not changed.

7. The method according to claim 1, further comprising:

determining whether the content is in a static display mode or a dynamic display mode; and acquiring pixel grayscale values of a row in the displayed content on the liquid crystal panel when the content is in the static display mode.

8. The method according to claim 7, wherein:

when the content remains unchanged for a predetermined period of time, the content is in the static display mode.

9. The method according to claim 7, further comprising:

maintaining refreshing rates of each row of the content when the content is in the dynamic mode.

10. A liquid crystal display device, comprising:

a processor;

a display chip coupled to the processor;

a liquid crystal panel in communication with the display chip; and a memory storing instructions executable by the processor, the memory in communication with the processor, wherein, when the processor executes the instructions, the processor is configured to cause the liquid crystal display device to:

receive pixel grayscale values of all selected pixels in a row of content displayed on the liquid crystal panel;

determine whether the pixel grayscale values of all the selected pixels in an i-th row of the displayed content are each lower than a predetermined value;

when it is determined that the pixel grayscale values of all the selected pixels in the i-th row of the displayed content are each lower than the predetermined value, set a refresh rate of the i-th row in the displayed content to a first refresh rate without changing any of the pixel grayscale values of all the pixels in the i-th row;

determine whether at least one pixel grayscale value of all the selected pixels in a j-th row is not lower than the predetermined value; and when it is determined that the at least one pixel grayscale value of all the selected pixels in the j-th row is not lower than the predetermined value, set a refresh rate of the j-th row in the displayed content to a second refresh rate without changing any of the pixel grayscale values of all the pixels in the j-th row, wherein the first refresh rate is lower than the second refresh rate.

11. The liquid crystal display device according to claim 10, wherein, when the processor executes the instructions, the processor is further configured to cause the liquid crystal display device to:

send to the display chip a refresh rate setting instruction corresponding to the i-th row in the displayed content when it is determined that the grayscale values of all the selected pixels in the i-th row are lower than the predetermined value.

12. The liquid crystal display device according to claim 10, wherein the first refresh rate is less than 50 Hz.

13. The liquid crystal display device according to claim 10, wherein, when the processor executes the instructions, the processor is further configured to cause the liquid crystal display device to:

determine whether the content has changed; and acquire a pixel grayscale value of each row of the changed content on the liquid crystal panel when the displayed content has changed.

14. The liquid crystal display device according to claim 10, wherein, when the processor executes the instructions, the processor is further configured to cause the liquid crystal display device to:

determine whether a row of the content has changed; and acquiring pixel grayscale values of pixels of the changed row when the row of the content has changed.

15. The liquid crystal display device according to claim 14, wherein, when the processor executes the instructions, the processor is further configured to cause the liquid crystal display device to:

maintain a refresh rate for the row when the row of the content has not changed.

16. The liquid crystal display device according to claim 10, wherein, when the processor executes the instructions, the processor is further configured to cause the liquid crystal display device to:

determine whether the content is in a static display mode or a dynamic display mode; and acquire pixel grayscale values of a row of the displayed content on the liquid crystal panel when the content is in the static display mode.

17. The liquid crystal display device according to claim 16, wherein:

when the content remains unchanged for a predetermined period of time, the content is in the static display mode.

18. The liquid crystal display device according to claim 16, wherein, when the processor executes the instructions, the processor is further configured to cause the liquid crystal display device to:

maintain refresh rates of each row of the content when the content is in the dynamic mode.

19. A non-transitory computer-readable storage medium having stored therein instructions that, when executed by a processor of a terminal, causes the terminal to:

acquire pixel grayscale values of all selected pixels in a row of a displayed content on a liquid crystal panel of the terminal;

determine whether the pixel grayscale values of the selected pixels in an i-th row of the displayed content are each lower than a predetermined value;

when it is determined that the pixel grayscale values of all the selected pixels in the i-th row of the displayed content are each lower than the predetermined value, set a refresh rate of the i-th row in the displayed content to a first refresh rate without changing any of the pixel grayscale values of all the pixels in the i-th row;

determine whether at least one pixel grayscale value of all the selected pixels in a j-th row is not lower than the predetermined value; and when it is determined that the at least one pixel grayscale value of all the selected pixels in the j-th row is not lower than the predetermined value, setting a refresh rate of the j-th row in the displayed content to a second refresh rate without changing any of the pixel grayscale values of all the pixels in the j-th row, wherein the first refresh rate is lower than the second refresh rate.

* * * * *